US006203316B1

(12) United States Patent
Pennington

(10) Patent No.: US 6,203,316 B1
(45) Date of Patent: Mar. 20, 2001

(54) CONTINUOUS ON-LINE SMOKELESS BAKE-OUT PROCESS FOR A ROTARY OXIDIZER

(75) Inventor: Rodney L. Pennington, Morristown, NJ (US)

(73) Assignee: Regenerative Environmental Equipment Co., Inc. (REECO, Inc.), Bridgewater, NJ (US)

( * ) Notice: Subject to any disclaimer, the term of this patent is extended or adjusted under 35 U.S.C. 154(b) by 0 days.

(21) Appl. No.: 09/438,456

(22) Filed: Nov. 12, 1999

(51) Int. Cl.[7] ..... F27D 17/00

(52) U.S. Cl. ..... 432/180; 432/2; 422/178; 165/5

(58) Field of Search ..... 432/2, 179, 180, 432/181; 110/210, 211; 422/173, 175, 178; 165/4, 5, 7, 8

(56) References Cited

U.S. PATENT DOCUMENTS

| | | | | |
|---|---|---|---|---|
| 4,280,416 | * | 7/1981 | Edgerton | 165/4 |
| 5,016,547 | | 5/1991 | Thomason . | |
| 5,352,115 | | 10/1994 | Klobucar . | |
| 5,503,551 | * | 4/1996 | Houston | 432/180 |
| 5,538,420 | | 7/1996 | Klobucar et al. . | |
| 5,562,442 | | 10/1996 | Wilhelm . | |
| 5,692,892 | * | 12/1997 | Houston | 432/180 |
| 5,707,229 | | 1/1998 | Klobucar . | |
| 5,730,945 | * | 3/1998 | Klobucar | 432/181 |
| 5,871,349 | * | 2/1999 | Johnson et al. | 432/180 |

FOREIGN PATENT DOCUMENTS 791222 2/1958 (GB) .

* cited by examiner

*Primary Examiner*—Denise L. Ferensic
*Assistant Examiner*—Gregory A. Wilson
(74) *Attorney, Agent, or Firm*—Howard & Howard

(57) ABSTRACT

A rotary valve regenerative oxidizer generally includes a combustion chamber communicating with a first end of plurality of pie shaped heat exchange chambers and a rotary valve communicating with a second end of the heat exchange chambers. A contaminated gas is directed through an inlet of the rotary valve, through a first group of heat exchange chambers, and into the combustion chamber thereby heating and purifying the gas. The heated and purified gas is directed from the combustion chamber through a second group of heat exchange chambers and through an outlet of the rotary valve. A portion of the heated and purified gas received from the outlet of the rotary valve is directed through a heating element 56 for heating the gas to a temperature sufficient to volatilize organic solids for purging a third group of heat exchange chambers. The gas is directed from the third group of heat exchange chambers into the combustion chamber and out of the oxidizer through the second group of heat exchange chambers.

23 Claims, 2 Drawing Sheets

CONTINUOUS ON-LINE SMOKELESS BAKE-OUT PROCESS FOR A ROTARY OXIDIZER

BACKGROUND OF THE INVENTION

The subject invention relates to an improved method for cleaning the elements of a rotary valve regenerative oxidizer. More specifically, the subject invention relates to a method for continuously cleaning the elements of rotary valve regenerative oxidizer while on-line.

Regenerative oxidizes are used to remove contaminated gas, such as volatile or condensable and particulate organic compounds from an air stream. The contaminated gas is typically generated from an industrial process such as, for example a paint application or bake process in an automotive paint shop, and the wood industry, grain industry, etc. Two types of regenerative oxidizers are commonly used, a thermal oxidizer, and a catalytic oxidizer. The regenerative thermal oxidizer removes contaminated gas by a combustion reaction. To remove the contaminated gas, the combustion reaction must reach a temperature that breaks down the volatile organic compounds to corresponding $CO_2$ and $H_2O$. The catalytic oxidizer removes the contaminated gas by a catalyzed reaction that is typically an exothermic reaction. This is achieved by accelerating the oxidation process of volatile organic compounds with precious metals on a ceramic substrate.

Referring to a thermal oxidizer, which is more widely used than a catalytic oxidizer, the contaminated gas is passed through a first heat exchange chamber having a media disposed therein. The media is preheated to a combustion temperature to facilitate the combustion reaction as the gas contacts the media. The heated and purified gas passes through a single or a plurality of first heat exchange chambers into a combustion chamber. The combustion chamber includes a flame source that only operates when heat is required to be added to the process, which is typically only during a start-up period. The heated and purified gas passes through the combustion chamber and into a second heat exchange chamber having media disposed therein and subsequently out of the oxidizer through an outlet stack. As the process continues the first heat exchange chamber will become fouled with organic solids that can build up to a level of becoming a potential source for fire.

As disclosed in U.S. Pat. No. 5,538,420 to Klobucar et al, to operate the oxidizer continuously, a third heat exchange chamber is added to the process. The third heat exchange chamber receives purge gas drawn from ambient air that has been passed through a heater element for heating the gas to a temperature that will clean volatilized organic solids from the media and walls of heat exchange chamber. The purge gas pass into the combustion chamber, and subsequently out through the second heat exchanger. The purge gas originates as ambient air and is heated from ambient air temperature to the cleaning temperature. The Klobucar et al patent discloses three independent chambers each having an inlet valve, an outlet valve, and a purge valve. The valves cycle during operation so that one chamber is operating as in inlet chamber for heating and purifying the gasses, one chamber is operating as an outlet chamber, and one chamber is being cleaned.

The Klobucar et al patent provides the ability to operate the regenerative oxidizer continuously. However, the valves required for continuous operation are complex and costly. In addition, heating ambient air to a temperature high enough to clean organic solids from the heat exchange chambers is not energy efficient and adds to the operating costs. The valve design also prevents rapid rotation of heat exchange chambers to the cleaning stage of the process.

An alternative embodiment is disclosed in English Patent no. 791,222. The invention, as disclosed in this patent, replaces the three valves disclosed in the Klobucar et al patent with a rotary valve. The rotary valve includes an inlet section, an outlet section, and a purge section, each aligned with pie shaped heat exchange chambers that are arranged in a circular fashion. The rotary valve pivots about a tubular member 40 for alternating the chambers that align with the various valve sections. Cleaning vapors are directed into the tubular member and through the purge section for cleaning volatilized solids from the heat exchange chambers.

The English '222 patent discloses a more simplified structure by replacing the valves, as disclosed in the Klobucar et al patent, with a rotary valve. It does not, however, disclose a method for reducing the energy requirements associated with cleaning the various heat exchange chambers.

Therefore, a need exists for a method of continuously cleaning the heat exchangers in a regenerative oxidizer at a rapid rate, and in an energy and cost efficient manner.

SUMMARY OF THE INVENTION AND ADVANTAGES

A regenerative oxidizer includes a combustion chamber and a plurality of pie shaped heat exchange chambers having media disposed therein. As used herein, pie-shaped refers to radial sections of a cylinder and the sections are generally equal. The heat exchange chambers are arranged in a symmetrical or circular fashion. Each of the heat exchange chambers communicates with the combustion chamber at a first end and communicates with a rotary valve at a second end. The oxidizer includes at least a first, second, and third group of heat exchange chambers.

A method for continuously operating the oxidizer includes directing a contaminated gas through an inlet of the rotary valve, through the media disposed within the first group of heat exchange chambers and into the combustion chamber thereby heating and purifying the gas. The heated and purified gas is directed from the combustion chamber through the media disposed within the second group of heat exchange chambers and through an outlet of the rotary valve.

A portion of the heated and purified gas received from the outlet of the rotary valve is continuously directed through a heating element. The gas is directed into a urge section of the rotary valve and through the media disposed within the third group of heat exchange chambers for cleaning the media. The gas passes through the combustion chamber and out of the oxidizer through the second group of heat exchange chambers.

The heated and purified gas is heated by the heating element for creating a purge gas at a cleaning temperature selected to be sufficient to oxidize organic solids which are expected to be coated on the plurality of the heat exchange chambers and the media disposed therein.

The rotary valve is sequenced for aligning the purge section of the rotary valve with a heat exchange chamber originally from the first group of heat exchange chambers and with a heat exchange chamber originally from the second group of heat exchange chambers. This allows for rapid and continuous cleaning of the heat exchange chambers while the oxidizer is operating.

By heating the heated and purified gas to a temperature selected to be sufficient to oxidize organic solids rather than heating ambient air, as disclosed in the prior art, energy requirements are reduced, thereby producing a more efficient process. In addition, continuously sequencing the rotary valve to prevent the buildup of volatilized organic solids in the heat exchange chambers reduces the potential for fires inside the chambers caused from the solids build up.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
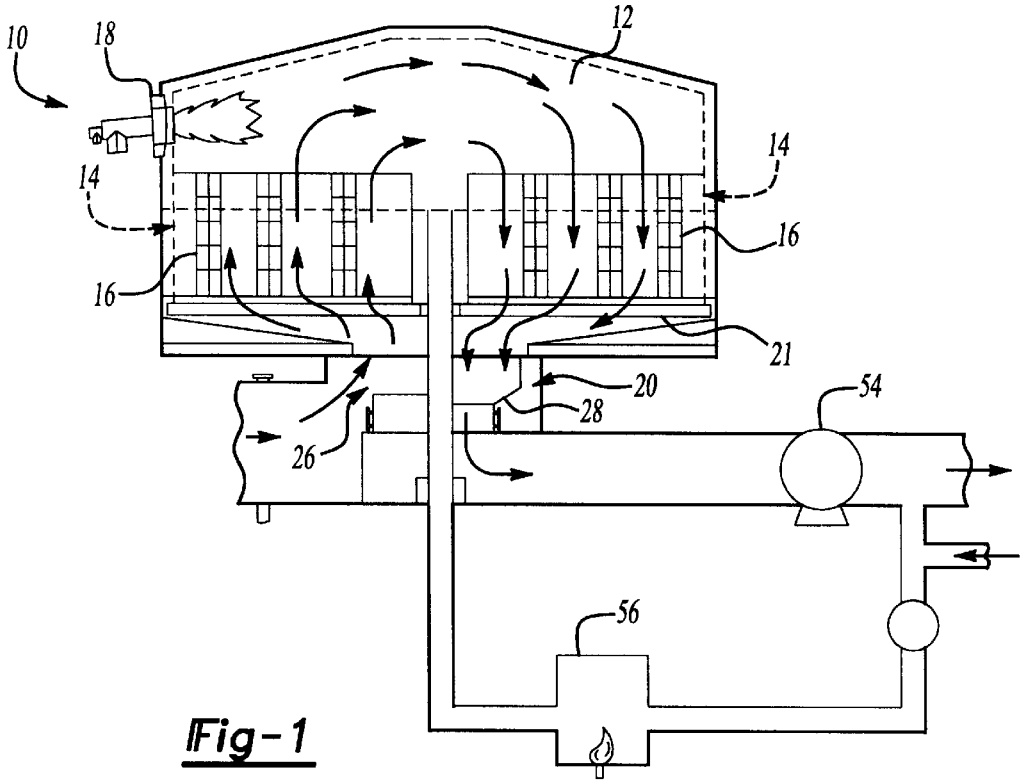
FIG. 1 is a schematic of the regenerative rotary valve oxidizer of the subject invention.

Referring to the Figures, wherein like numerals indicate like or corresponding parts throughout the several views, a rotary valve regenerative oxidizer is generally shown at 10 including a combustion chamber 12 and a plurality of pie shaped heat exchange chambers 14 each having heat exchange media 16 disposed therein. The combustion chamber 12 typically includes a burner 18 for providing heat to the oxidizer 10 during start up of the oxidizer 10 and thereafter during steady state operation if additional heat is required. The media 16 disposed within the heat exchange chambers 14 holds heat for performing the oxidation reactions required for cleaning contaminated gas. The oxidation reaction can be initiated through a combustion process or a catalyzed process as will be explained further hereinbelow.

The heat exchange chambers 14 are arranged in a circular fashion. Each of the heat exchange chambers 14 communicates with the combustion chamber 12 at a first end 19 and communicates with a rotary valve 20 at a second end 21. The second end 21 of each of the heat exchange chambers 14 align with a pie shaped opening 22 in a stator 24 positioned between the rotary valve 20 and the chambers 14. The oxidizer 10 includes at least a first, second, and third group of heat exchange chambers 14. The oxidizer 10 is contemplated to include up to, but not limited to, a total of twelve individual heat exchange chambers 14.

Contaminated gas is directed through an inlet 26 of the rotary valve 20, through the media 16 disposed within the first group of heat exchange chambers 14 and into the combustion chamber 12 thereby heating and purifying the gas. The heated and purified gas from the combustion chamber 12 is directed through the media 16 disposed within the second group of heat exchange chambers 14 and through an outlet 28 of the rotary valve 20.

A valve plate 30 is affixed to the top of a valve rotor 32 for directing the flow of gas through the oxidizer 10. The valve plate 30 includes an inlet port 34, an outlet port 36 and a purging port 38. The rotor 32 pivots about a tubular member 40 projecting vertically through an outlet housing 44 having a smaller diameter than, and located within a valve housing 42. Contaminated gas passes through an inlet plenum 46 into an inlet chamber 48 defined between the valve housing 42 and the outlet housing 44. The contaminated gas is channeled through the inlet port 34 and into the first group heat exchange chambers 14.

The heated and purified gas passes from the second group of heat exchange chambers 14 through the outlet port 36 and into an outlet chamber 50 located within the outlet housing 44. The heated and purified gas is channeled out of the outlet chamber 50 through an outlet plenum 52 to an exhaust stack (not shown).

A negative pressure differential is created between the inlet 26 and the outlet 28 of the rotary valve 20 for directing the flow of gas through the regeneration oxidizer 10. A fan 54 is located down stream from the outlet plenum 52 for creating the negative pressure differential. An alternative design locates the fan 54 prior to the inlet plenum 46 for creating a positive pressure differential. Either location for the fan 54 suffices to establish the necessary pressure differential between the inlet plenum 46 and the outlet plenum 52 for directing the flow of gas through the oxidizer 10.

A portion of the heated and purified gas received from the outlet 28 of the rotary valve 20 is directed through a heating element 56. The gas is directed into a tubular member 40 of the rotary valve 20 and through the media 16 disposed within the third heat exchange chamber 14 for cleaning the media 16. Purge gas is directed through the tubular member 40 into a purge chamber 58 that separates the valve inlet 26 from the valve outlet 28. The purge chamber 58 is capped at the top by a purge port 60. The purge port 60 includes at least one aperture 62 though which the purge gas is channeled into the third group of heat exchange chambers 14. The purge gas passes through the third group of heat exchange chambers 14 into the combustion chamber 12 and out of the oxidizer 10 through the second group of heat exchange chambers 14.

The heated and purified gas is heated to a greater temperature by the heating element 56 for creating the purge gas at a cleaning temperature selected to be sufficient to volatilize organic solids which are expected to be coated on the plurality of the heat exchange chambers 14 and the media 16 disposed therein. The purge gas is preferably heated to a temperature greater than about 600° F. More specifically, the purge gas is preferably heated to a temperature between about 800° F. and 1000° F. The heated and purified gas leaves the outlet plenum 52 at a temperature between about 150° F. and 500° F. About five percent of the heated and purified gas received from the outlet 28 of the rotary valve 20 is continuously routed though the third group of heat exchange chambers 14.

A significant amount of energy savings are achieved because the heated and purified gas is already at a temperature well above ambient. It is contemplated that a combination of ambient air and heated and purified gas will make up the purge gas. However, the makeup of the purge gas can be optimized to meet the needs of a particular process.

The purge gas is propelled through the purge section of the rotary valve 20 with a purge fan 62. The purge fan 62 is located upstream of the heater element 56 to prevent the high temperatures produced by the heater element 56 from adversely effecting the purge fan 62.

The rotary valve 20 is sequenced for aligning the purge section of the rotary valve 20 with a heat exchange chamber 14 originally part of the first group of heat exchange chambers 14 that communicate with the inlet port 34, and with a heat exchange chamber 14 originally part of the second group of heat exchange chambers 14 that communicate with the outlet port 36. This allows for rapid and continuous cleaning of the heat exchange chambers 14 while the oxidizer 10 is operating.

The rotary oxidizer 10 is preferred to include up to twelve heat exchange chambers 14, as is represented in the Figures.

Figure 3:
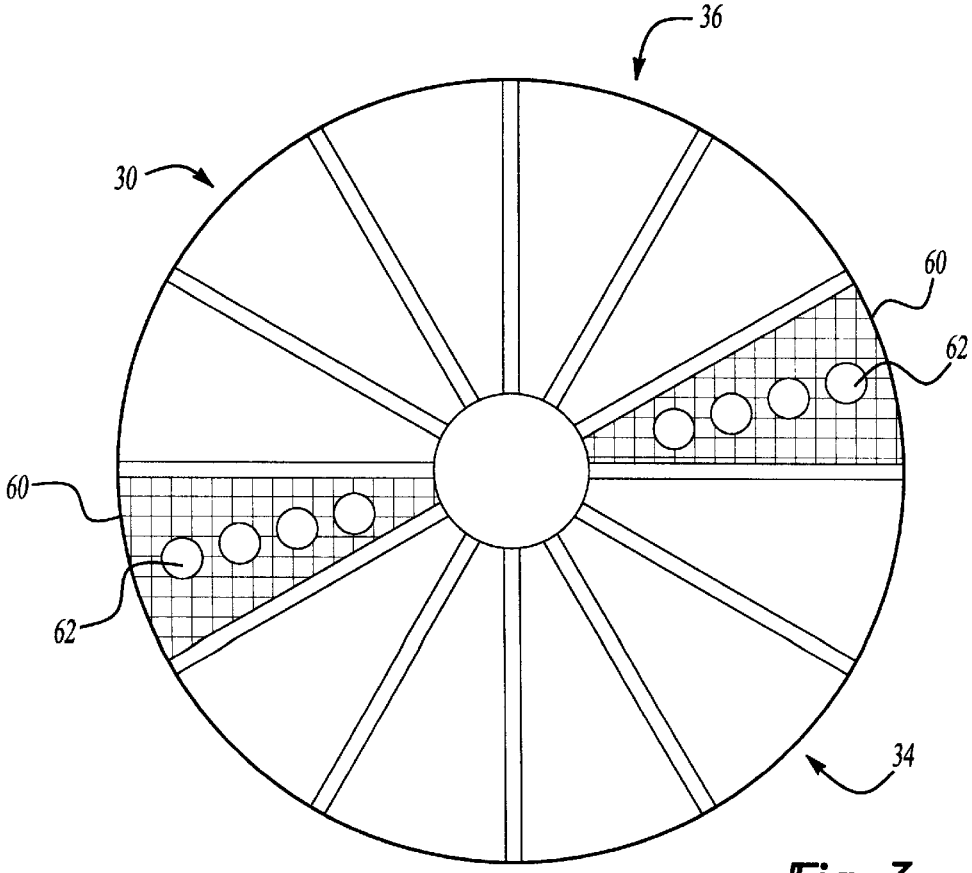
FIG. 3 is top view of the valve plate of the subject invention.
Figure 2:
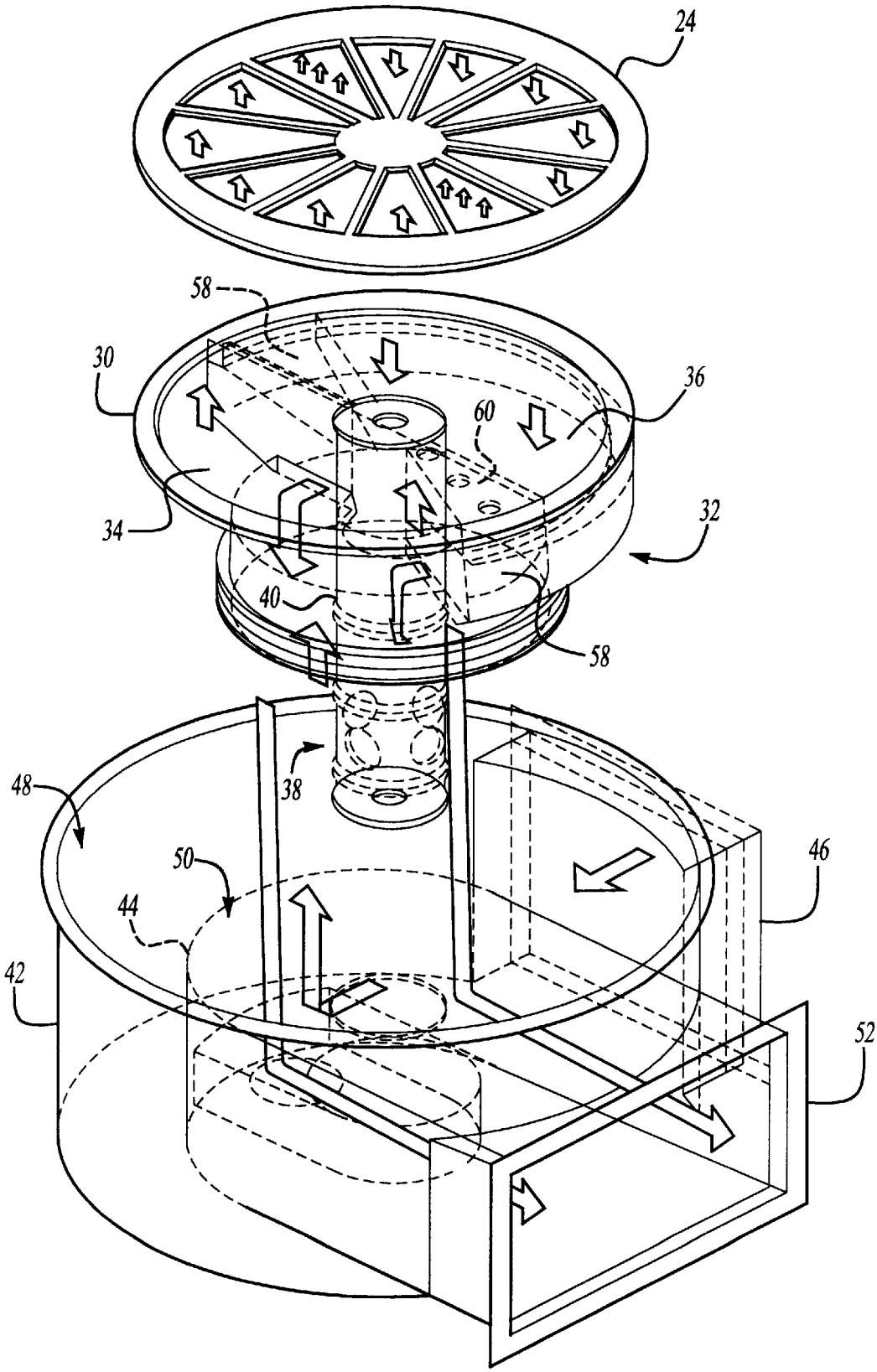
FIG. 2 is an exploded view of the regenerative oxidizer of the subject invention.

For this configuration, several heat exchange chambers 14 will be in communication with the inlet port 34 and several heat exchange chambers 14 will be in communication with the outlet port 36 at any given time. As shown in FIG. 3, a plurality of purge ports 60 are aligned 180 degrees apart on the valve plate 30 and separate the inlet port 34 and the outlet port 36. Therefore, two of the twelve heat exchange chambers 14 are being cleaned concurrently. At fifteen to twenty second intervals the valve rotates the length of one heat exchange chamber 14 allowing each chamber 14 to be cleaned within a two minute interval. Therefore, two different heat exchange chambers 14 are cleaned upon rotation, one chamber that was previously in communication with the inlet port 34 and one chamber that was previously in communication with the outlet port 36. The rotation effectively heats one chamber 14 to a temperature sufficient to carry out the oxidation reaction, and cleans one chamber 14 to eliminate organic solids from contaminating the cleaned gasses.

The contaminated gas is purified through a particulate media 16. The particulate media 16 comprises ceramic particles known to withstand the extreme temperature changes within the heat exchange chambers 14. Where the regenerative oxidizer 10 is a catalytic oxidizer, the top few inches comprise catalytic media 16, such as ceramic particles coated with precious metals known in the art. Alternatively, the gas is purified through a structured media 16. The structured media 16 can take the form of cylindrical tubes (not shown) or other structured shapes that increase the contact surface area within the heat exchange chamber 14. The structured media 16 is also formed from a ceramic material, or any material capable of withstanding the extreme temperatures inside the heat exchange chamber 14.

During steady state operation, the media 16 heats to a temperature that causes combustion thereby purifying the gas through a combustion reaction. The volatile organic compounds fuel the combustion reaction and continue to heat the media 16. An alternative embodiment includes a media 16 coated with a precious metal for purifying the contaminated gas with an exothermic catalysis reaction. It is likely that a combination of a combustion reaction and a catalysis reaction would occur within this type of heat exchange chamber 14. In either case, the volatile organic compounds provide the energy necessary to maintain the reaction temperature required to purify the contaminated gas.

The invention has been described in an illustrative manner, and it is to be understood that the terminology which has been used is intended to be in the nature of words of description rather than of limitation.

Many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A method for cleaning the elements of a regenerative oxidizer having a combustion chamber and a plurality of pie shaped heat exchange chambers, said heat exchange chambers having media disposed therein, and being arranged in a symmetrical fashion, each of said heat exchange chambers communicating with said combustion chamber at a first end and communicating with a rotary valve at a second end, said oxidizer having at least a first, second, and third group of heat exchange chambers, said method comprising the steps of:

directing a contaminated gas through an inlet of said rotary valve, through said media disposed within said first group of heat exchange chambers and into said combustion chamber thereby heating and purifying the gas;

directing the heated and purified gas from the combustion chamber through said media disposed within said second group of heat exchange chambers and through an outlet of the rotary valve;

directing a portion of the heated and purified gas received from said outlet of said rotary valve through a heating element and into a purge section of said rotary valve for directing the gas through said media disposed within said third group of heat exchange chambers and into said combustion chamber for cleaning said media, the gas leaving said combustion chamber through said second heat exchange chamber;

heating the heated and purified gas with said heating element to a temperature sufficient to oxidize organic contaminants on said media for creating a purge gas at a cleaning temperature selected to be sufficient to oxidize organic solids which are expected to be coated on said plurality of said heat exchange chambers and said media disposed therein; and sequencing said rotary valve for aligning said purge section of said rotary valve with a heat exchange chamber from said first group of heat exchange chambers and a heat exchange chamber from said second group of heat exchange chambers.

2. A method as group forth in claim 1 wherein said step of heating the purge gas is further defined by heating the purge gas to a temperature greater than about 600° F.

3. A method as group forth in claim 2 wherein said step of periodically heating the purge gas is further defined by heating the purge gas to a temperature between about 800 F. and 1000 F.

4. A method as group forth in claim 1 further including the step of propelling the purge gas through said purge section of said rotary valve with a fan.

5. A method as group forth in claim 1 wherein said step of purifying the contaminated gas is further defined by purifying the gas through a ceramic media disposed within said heat exchange chambers with a combustion reaction.

6. A method as group forth in claim 5 wherein said step of purifying the contaminated gas is further defined by purifying the gas through a particulate media.

7. A method as group forth in claim 5 wherein said step of purifying the contaminated gas is further defined by purifying the gas through a structured media.

8. A method as group forth in claim 1 wherein said step of purifying the contaminated gas is further defined by purifying the gas with a catalysis reaction by passing the gas through a media coated with a precious metal.

9. A method as group forth in claim 1 wherein said step of purifying the contaminated gas is further defined by purifying the gas with a combination of a combustion reaction and a catalysis reaction.

10. A method as group forth in claim 1 wherein said step of passing a portion of the purge gas through said third group of heat exchange chambers includes directing about 5% of the heated and purified gas received from said outlet of said rotary valve though said third group of heat exchange chambers.

11. A method as group forth in claim 1 further including the step of creating a pressure differential between said inlet of said rotary valve and said outlet of said rotary valve for directing the flow of gas through said regeneration oxidizer.

12. A method for cleaning the elements of a regenerative oxidizer having a heat exchange chamber with a plurality of pie shaped sections being organized in a symmetrical fashion, each of said sections having heat exchange media disposed therein, and said heat exchange chamber being in communication with a transfer chamber at a first end and a rotary valve having an inlet section, an outlet section, and a purge section at a second end, said method comprising the steps of:

directing contaminated gas through said pie shaped sections aligning with said inlet section of said rotary valve and into said transfer chamber thereby heating and purifying the gas;

continuously directing the heated and purified gas from said transfer chamber through said pie shaped sections aligning with said outlet section of said rotary valve;

directing a portion of the heated and purified gas being at a first temperature and being received from said outlet of said rotary valve through a heating element for heating the gas to a greater second temperature sufficient to oxidize organic contaminants prior to directing the gas into a purge section of said rotary valve;

directing the heated and purified gas being at the second temperature through said pie shaped sections aligning with said purge section of said rotary valve for cleaning said media disposed within said pie shaped sections; and rotating the rotary valve for aligning said purge section of said rotary valve with different of said pie shaped sections for directing the heated and purified gas at the second temperature through different of said pie shaped sections before a sufficient amount of volatile organic solids can accumulate within said pie shaped sections to cause combustion.

13. A method as group forth in claim 12 wherein said step of heating the heated and purified gas to a second temperature is further defined by heating the gas to a cleaning temperature selected to be sufficient to oxidize organic solids which are expected to be coated within heat exchange chamber.

14. A method as group forth in claim 13 further including heating the heating the heated and purified gas to a second temperature greater than 600° F.

15. A method as group forth in claim 14 further including heating the heated and purified gas to a second temperature between about 800° F. and 1,000° F.

16. A method as group forth in claim 15 further including the step of propelling the purge gas through said purge section of said rotary valve with a fan.

17. A method as group forth in claim 12 further including the step of heating and purifying the gas through a ceramic media disposed within said heat exchange chambers.

18. A method as group forth in claim 12 further including the step of heating and purifying the gas through a particulate media.

19. A method as group forth in claim 12 further including the step of heating and purifying the gas through a structured media.

20. A method as group forth in claim 12 further including the step of heating and purifying the gas through a media coated with a precious metal.

21. A method as group forth in claim 12 wherein said step of passing a gas through said pie shaped sections aligning with said purge section of said rotary valve includes directing about 5% of the heated and purified gas received from said outlet of said rotary valve though said through said pie shaped sections aligning with said purge section of said rotary valve.

22. A method as group forth in claim 12 further including the step of creating a pressure differential between said inlet of said rotary valve and said outlet of said rotary valve for directing the flow of gas through said regeneration oxidizer.

23. A method for cleaning the elements of a regenerative oxidizer having a heat exchange chamber with a plurality of pie shaped sections being organized in a symmetrical fashion, each of said sections having media disposed therein, and said heat exchange chamber being in communication with a transfer chamber at a first end and a rotary valve having an inlet section, an outlet section, and a purge section at a second end, said method comprising the steps of:

directing contaminated gas through said pie shaped sections aligning with said inlet section of said rotary valve and into said transfer chamber thereby heating and purifying the gas;

directing the heated and purified gas from said transfer chamber through said pie shaped sections aligning with said outlet section of said rotary valve;

directing a portion of the heated and purified gas being at a first temperature and being received from said outlet of said rotary valve through a heating element for heating the gas to a greater second temperature, selected to be sufficient to volatilize organic solids which are expected to be coated within heat exchange chamber, prior to directing the gas into a purge section of said rotary valve;

directing the heated and purified gas being at the second temperature through said pie shaped sections aligning with said purge section of said rotary valve for cleaning said media disposed within said pie shaped sections; and rotating the rotary valve for aligning said purge section of said rotary valve with different of said pie shaped sections for directing the heated and purified gas at the greater second temperature sufficient to oxidize organic contaminants through different of said pie shaped sections before a sufficient amount of volatile organic solids can accumulate within said pie shaped sections to cause combustion.

* * * * *